US006135701A

United States Patent [19]

Galloway, Sr.

[11] Patent Number: 6,135,701

[45] Date of Patent: Oct. 24, 2000

[54] FORK LIFT TOWING BAR FOR TRAILERS

[76] Inventor: Robert E. Galloway, Sr., 3514 Millet Ave., Ft. Worth, Tex. 76105

[21] Appl. No.: 09/251,199

[22] Filed: Feb. 16, 1999

[51] Int. Cl.[7] ..... B66F 009/12

[52] U.S. Cl. ..... 414/607; 414/785; 280/415.1

[58] Field of Search ..... 414/607, 608, 414/785, 462; 280/415.1, 478.1; 187/237; 254/2 R, DIG. 4

[56] References Cited

U.S. PATENT DOCUMENTS

| | | | |
|---|---|---|---|
| 2,809,759 | 10/1957 | Manker | 414/607 |
| 4,049,146 | 9/1977 | Decker | 414/607 |
| 4,243,354 | 1/1981 | Garcia | 414/607 |
| 4,881,866 | 11/1989 | Harmon | 414/607 |

*Primary Examiner*—Frank E. Werner

*Attorney, Agent, or Firm*—George L. Williamson

[57] ABSTRACT

The present invention discloses a device for a portable trailer hitch being attached to the forks of a fork lift truck or similar motorized vehicle. The device discloses an upper and lower frame member separated by spacer plates whereby the forks of the fork lift truck can be slidably inserted into slots between the upper and lower frame members. The upper frame member comprises nut and bolt tightening members or the like which secure the upper and lower frame members to the forks of the fork lift truck. Furthermore, the upper frame member comprises a channel member mounted thereon having a trailer hitch ball mounted to it. The lower member further comprises a vertical or perpendicularly mounted rectangularly shaped plate having an eye bolt and nut attached thereto, to which is attached a length of chain having a hook on its distal end whereby the hook is attached to the fork of the fork lift truck thereby providing a safety chain which will prevent the present invention from being pulled off the forks of the fork lift truck.

11 Claims, 2 Drawing Sheets

FORK LIFT TOWING BAR FOR TRAILERS

BACKGROUND OF THE INVENTION

1. Field of the Invention

The present invention relates generally to the field of trailer hitches, more particularly, to portable trailer hitch devices which are adaptable to be placed onto the forks of a motorized vehicle or fork lift truck.

2. Description of the Prior Art

Trailer hitches for fork lift trucks have been described in the prior art. However, none of the prior art discloses the unique features of the present invention.

In U.S. Pat. No. 5,570,897, dated Nov. 5, 1996, Wass disclosed a portable quick hitching device which connects to a vehicle equipped with a bucket or other attached implement. The base of the device is constructed so as to engage the lip of the bucket and to support a towing ball or wagon hitch pin. A brace attached to an opposing side of the bucket secures the base to the bucket.

In U.S. Pat. No. 5,297,911, dated Mar. 29, 1994, Powell disclosed an invention which pertains to an apparatus for lifting a container. The lifting apparatus has an elongate member having a first end and a second end and device for lockingly engaging the elongate member to the container, such as a fifth wheel plate attached to the elongate member which lockingly engages with the container. There is a first end attachment connected in proximity to the first end for connection to a mechanism which lifts the container through the apparatus and a second end attachment connected in proximity to the second end for connection to the mechanism which lifts the container through the apparatus. The invention is also a system for tilting a container. The system includes a fifth wheel plate and device for lifting the fifth wheel plate when it is lockingly engaged with the container. The fifth wheel plate is attached to the lifting device such that as the container is tilted by the lifting device through the fifth wheel plate, the fifth wheel plate remains lockingly engaged with the container. Preferably, the tilting device includes a vehicle, such as a bulldozer.

In U.S. Pat. No. 5,097,609, dated Mar. 24, 1992, Swaggert disclosed a portable draft bar which is demountably attached to a horizontally disposed surface of an earth-working implement that is adjustably disposed on an earthmoving vehicle by providing an elongated draft bar that is adapted at its rear end to be driveably attached to the rear portion of a horizontally-disposable surface of an earth-working implement, such as a front end loader, and which is slidably disposed in a clamp adapted to be clamped to a forward portion of the work surface so as to provide three-dimensional stability and connection of the draft bar to the vehicle for use as, for example, in moving trailers and the like.

In U.S. Pat. No. 4,065,013, dated Dec. 27, 1977, Orthman disclosed the spaced apart arms of a fork lift vehicle which are slidably received in sleeves mounted on the lower ends of spaced apart legs carried on a cross member. Upwardly facing hooks are provided on each of the legs and cross member for detachable engagement with hitch pins on a three-point mounted implement. A U-shaped stop having a cross member and perpendicular legs is pivotally connected through the free ends of the legs to the outer ends of the mounting sleeves opposite the hooks and is pivotal from a horizontal position for engagement with the standard of a fork lift vehicle to an upstanding inoperative position.

In U.S. Pat. No. 3,881,619, dated May 6, 1975, Morris disclosed a portable self-contained fifth wheel device for detachably mounting on a vehicle for pulling a wheeled container comprising a frame for detachable connection on a wheeled vehicle of the type having at least one support arm with the frame including a pivotally mounted support member for detachable connection to a wheeled container. The frame has at least one interlocking member including a hollow housing in the form of a guide track for slidably receiving the support arm, and the housing includes a fluid actuated lock means for selective locking engagement with the support arm for supportably mounting the container on the fifth wheel device.

In U.S. Pat. No. 2,809,759, dated Oct. 15, 1957, Manker disclosed an invention which relates to a fork lift truck bracket and more particularly to a bracket mountable on the forks of a fork lift truck and having a trailer hitch thereon for maneuvering trailers about with a fork lift truck.

While these prior art trailer hitch related devices may be suitable for the purposes for which they were designed, they would not be as suitable for the purposes of the present invention, as hereinafter described.

SUMMARY OF THE PRESENT INVENTION

The present invention discloses a device for a portable trailer hitch being attached to the forks of a fork lift truck or similar motorized vehicle. The device discloses an upper and lower frame member separated by spacer plates whereby the forks of the fork lift truck can be slidably inserted into slots between the upper and lower frame members. The upper frame member comprises nut and bolt tightening members or the like which secure the upper and lower frame members to the forks of the fork lift truck. Furthermore, the upper frame member comprises a channel member mounted thereon having a trailer hitch ball mounted to it. The lower member further comprises a vertical or perpendicularly mounted rectangularly shaped plate having an eye bolt and nut attached thereto, to which is attached a length of chain having a hook on its distal end whereby the hook is attached to the fork of the fork lift truck thereby providing a safety chain which will prevent the present invention from being pulled off the forks of the fork lift truck.

An object of the present invention is to provide a portable trailer hitch which can be used to move trailers from one location to another. A further object, is to provide a simple, inexpensive adapter means which will allow a fork lift truck to be used to move trailers about which expands the capability off a typical fork lift truck thereby increasing its versatility.

An objective of the present invention is to provide a trailer hitch mechanism which can be easily attached to a fork lift truck. A further objective, is to provide an adapter which can be attached to a fork lift truck which is safe to operate and simple to operate.

A further objective of the present invention is to provide a device which is adaptable to be used on many different types and styles of fork lift trucks. Another objective of the present invention is to provide a flexible trailer hitch means which is adaptable to be used for many different types and styles of trailers.

Other objects of the present invention will become obvious as the description of the present invention proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, a way of example, with reference to the accompanying drawings in which.

LIST OF REFERENCE NUMERALS

Figure 1:
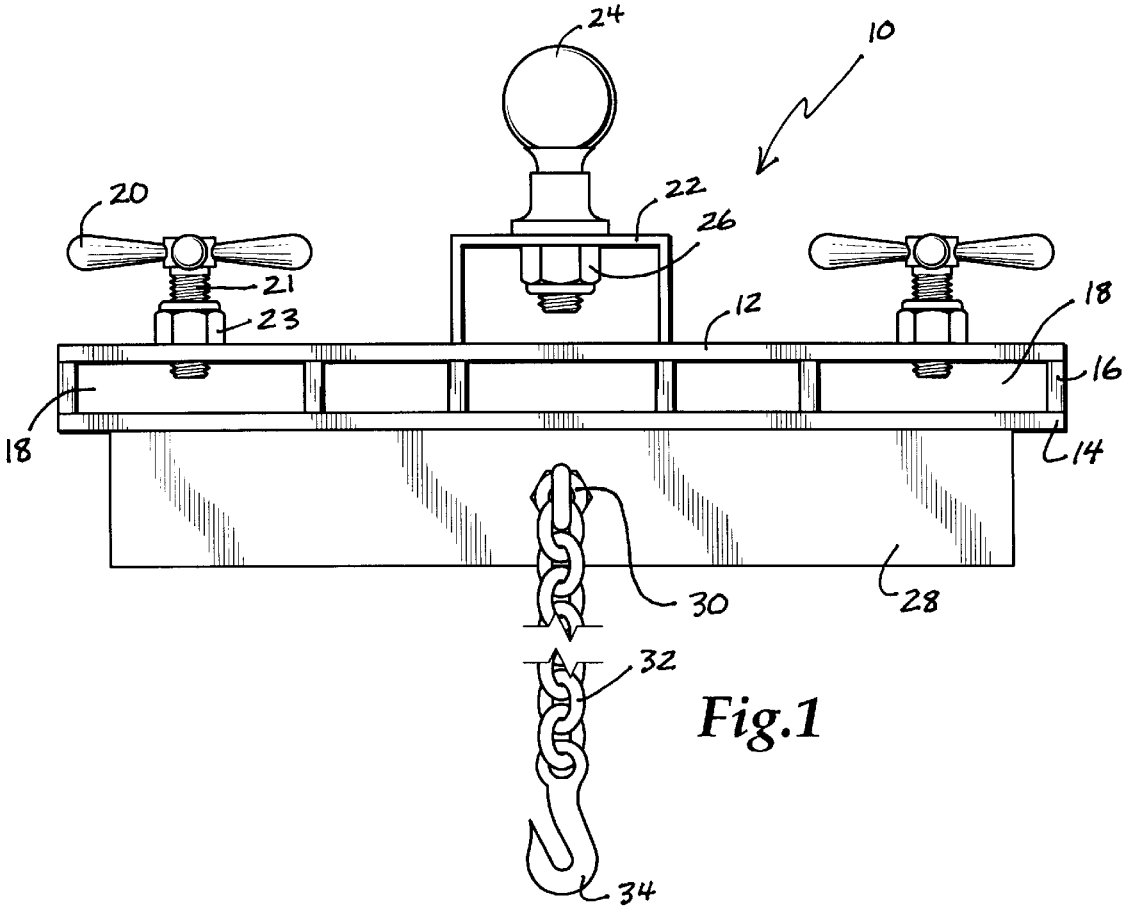
FIG. 1 is a front elevation view of the present invention.

With regard to the reference numerals used, the following numbering is used throughout the drawings:

10 present invention
12 upper plate
14 lower plate
16 spacers
18 slots
20 means for connecting
21 threaded male member
22 channel member
23 nut
24 hitch ball
26 means for connection
28 underside plate
30 connecting means
32 chain
34 chain hook
36 fork lift truck
38 forks
40 trailer
42 trailer tongue with hitch

DESCRIPTION OF THE PREFERRED EMBODIMENT(S)

Turning now descriptively to the drawings, in which similar reference characters denote similar elements throughout the several views, FIGS. 1 through 4 illustrate the present invention being a portable detachable trailer hitch for fork lift trucks or the like.

Turning to FIG. 1, therein is shown a front elevation view of the present invention generally shown at 10. Shown therein is a generally horizontal upper plate 12 and a generally horizontal lower plate 14 separated by a plurality of generally vertical spacers 16. The upper and lower members 12 and 14 along with the spacers 16 form a pair of rectangular shaped slots 18 on each end of the present invention. The purpose of the slots is to receive the forks of the fork lift 12 truck (not shown) so they are sized accordingly. Also shown are means for connecting 20 the present invention 10 to the forks of the fork lift truck (not shown) said means 20 being lockably and detachably connected to the forks. Also shown is a channel member 22 upon which is attached a trailer hitch ball 24 having means for connection 26 to the channel member 22. Trailer hitch balls 24 ranging from 1⅞" and up are suitable for the present invention. Also shown on the underside of the lower plate 14 is a generally vertically standing rectangular shaped plate 28 perpendicular to lower member 14 having centrally mounted thereon a connecting means 30 for attaching a chain 32 thereto wherein the chain 32 has a chain hook 34 attached to its distal end.

Figure 2:
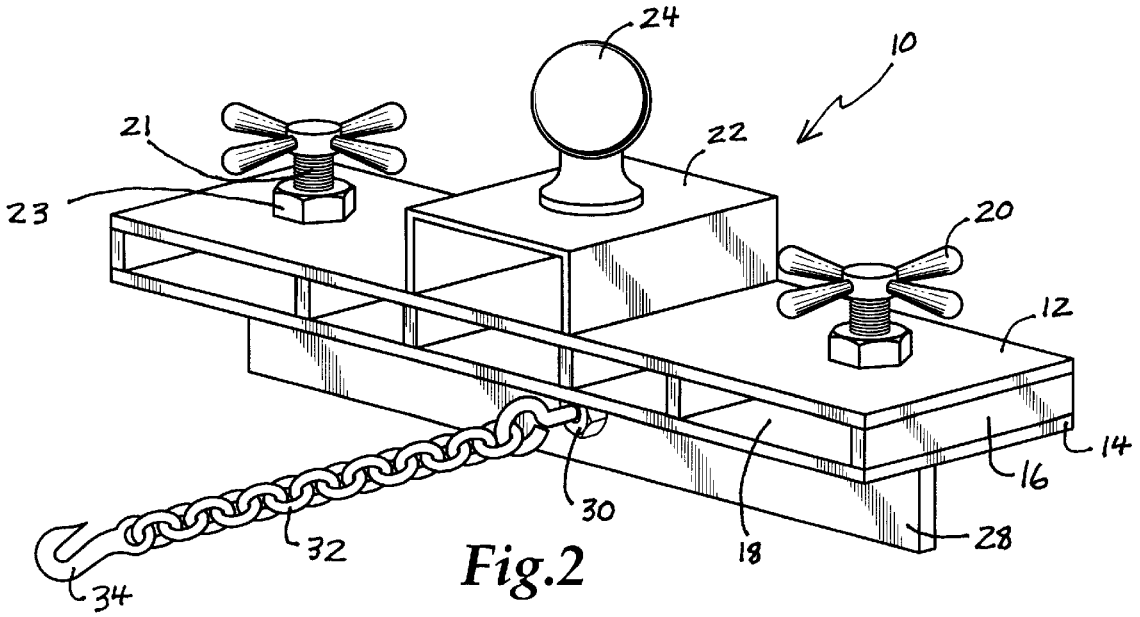
FIG. 2 is a perspective view of the present invention.

Turning to FIG. 2, therein is shown a perspective view of the present invention 10. Shown therein is an upper plate 12 and a lower plate 14 separated by a plurality of spacers 16. The upper and lower members 12 and 14 along with the spacers 16 form a pair of rectangular shaped slots 18 on each end of the present invention for receiving the forks of fork lift truck (not shown). Also shown are means for connecting 20 the present invention 10 to the forks of the fork lift truck (not shown). Means 20 could comprise a threaded male member 21 having a tightening nut 23 attached thereto along with a handle. The plate 12 has a threaded aperture (not shown) through which the male member 21 is threaded and passes. Also shown is a channel member 22 upon which is attached a trailer hitch ball 24 having means for connection (not shown) to the channel member 22. Also shown on the underside of the lower plate 14 is a generally vertically standing rectangular shaped plate 28 having centrally mounted thereon a connecting means 30 for attaching a chain 32 thereto wherein the chain 32 has a chain hook 34 attached to its distal end. Means 30 could comprise an eye bolt or the like having attachment means to the vertical member 28 being a nut, welding or the like.

Figure 3:
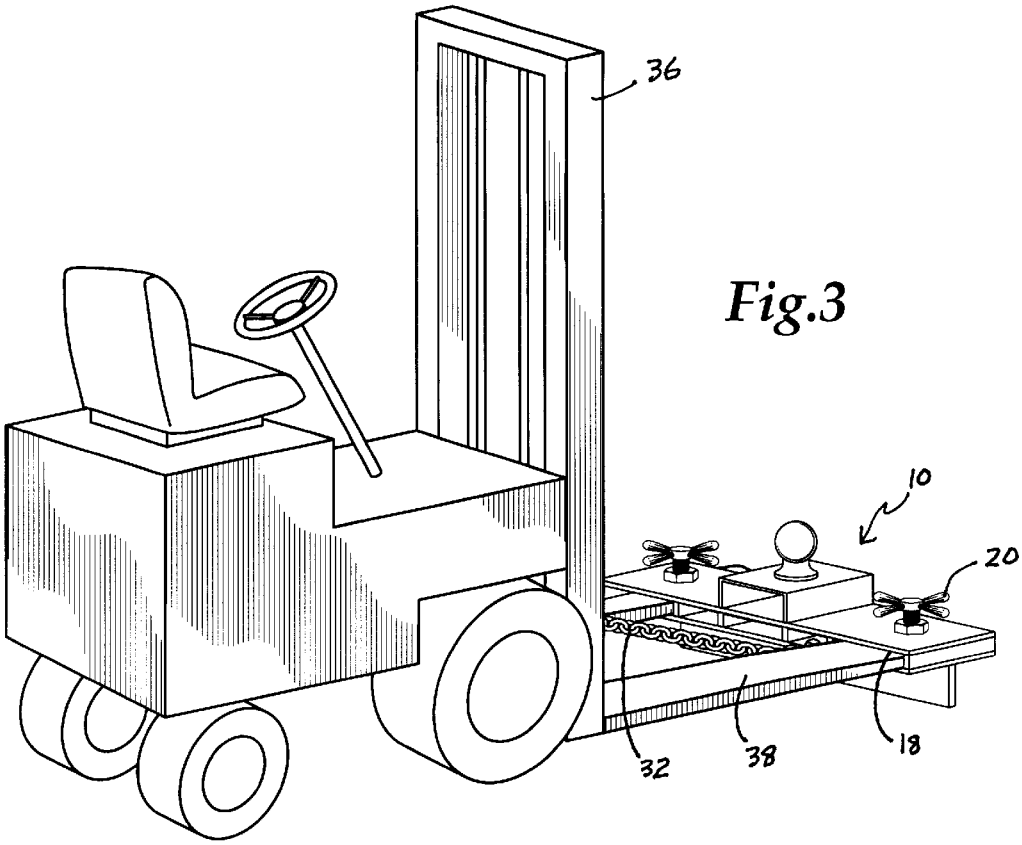
FIG. 3 is a perspective view of the present invention in operative connection with a fork lift truck.

Turning to FIG. 3, therein is shown the present invention 10 in operative connection with a fork lift truck 36. The slots 18 of each end of the present invention 10 are mounted onto the forks 38 or otherwise have the forks inserted therein. After insertion of the forks 38 into the slots 18 of the present invention 10 the means for connecting 20 are tightly engaged so that the present invention 10 is safely and securely attached to the forks 38 of a fork lift truck 36. Note that the chain 32 is also attached to the fork lift truck 36 in a conventional manner so as to prevent the present invention 10 from being pulled away from the fork lift truck 36 and therefore off of the forks 38.

Figure 4:
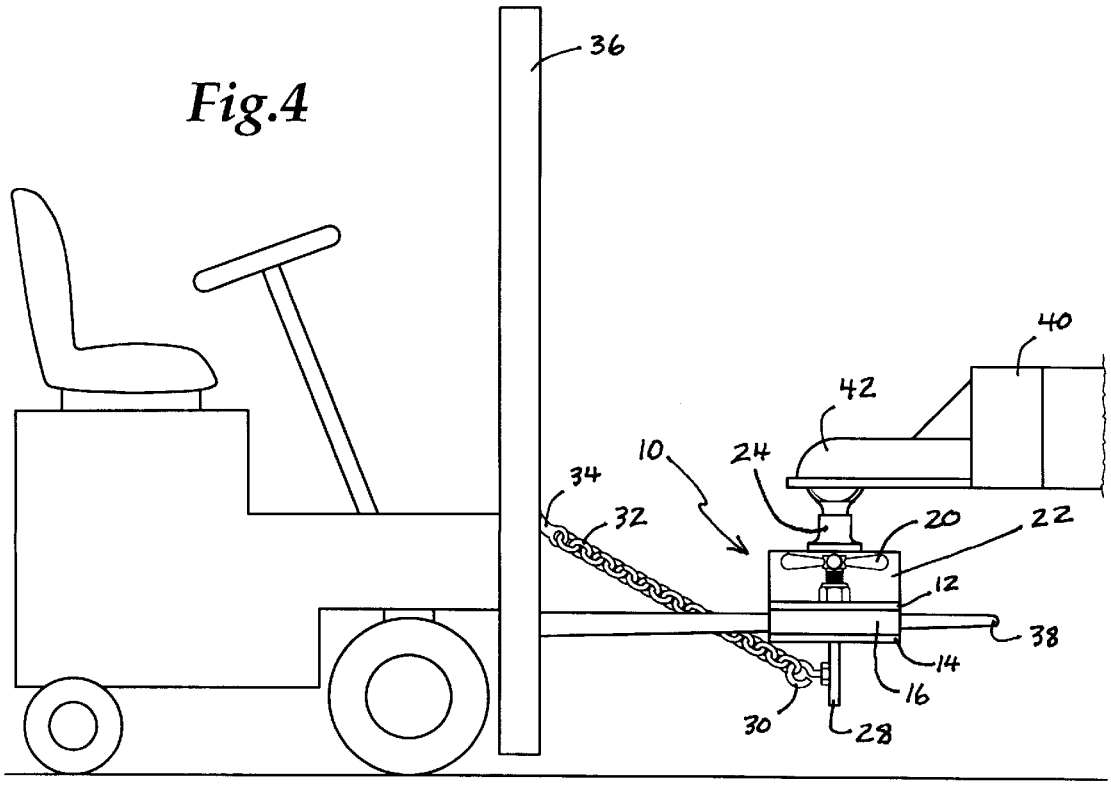
FIG. 4 is a side elevation view of the present invention in operative connection with a fork lift truck and trailer.

Turning to FIG. 4, therein is shown an upper plate 12 and a lower plate 14 separated by a plurality of spacers 16. The upper and lower members 12 and 14 along with the spacers 16 form a rectangular shaped slot 18 (not shown) on each end of the present invention. The purpose of the slots is to receive the forks 38 of the fork lift truck 36. Also shown are means for connecting 20 the present invention 10 to the forks 38 of the fork lift truck 36. Also shown is a channel member 22 upon which is attached a trailer hitch ball 24 having means for connection to the channel member 22. Also shown on the underside of the lower plate 14 is a generally vertically standing rectangular shaped plate 28 having centrally mounted thereon a connecting means 30 for attaching a chain 32 thereto wherein the chain 32 has a chain hook 34 attached to its distal end. Also shown is a trailer 40 with tongue and trailer hitch 42 both being of a conventional design.

The present invention is expected to be constructed of steel plate being about 3/16" to ½" in thickness. The steel plates of the apparatus is expected to be welded or spot welded or like means used for construction as would be done in standard practice.

What is claimed to be new and desired to be protected by Letters Patent is set forth in the claims:

1. A portable trailer hitch for mounting on a fork lift truck, comprising:

a) a upper generally horizontal member;

b) a lower generally horizontal member;

c) a plurality of generally vertical spacers separating said upper member and said lower member;

d) said upper member and said lower member and said spacers forming a frame having a pair of slots therein for receiving the forks of a fork lift truck;

e) a first means for attaching said frame to the forks of the fork lift truck;

f) a trailer hitch ball;

g) a second means for attaching said trailer hitch ball to said frame whereby a trailer hitch can be attached thereto, said second means for attacthing said trailer hitch ball to said frame further comprising means for a channel member whereby said trailer hitch ball is positioned in an elevated position above said frame, said channel member further having an aperture therein, said channel member elevating said trailer hitch ball above said frame;

h) said pair of slots sized to receive the forks of the fork lift truck, said pair of slots having a first end and a second end, said first end and said second end having an opening therein, said pair of openings having the forks of the fork lift truck pass therethrough whereby the forks of the fork lift truck extend through said pair of openings and are thereby attached thereto; and, i) said frame being movably disposed along an entire length of the forks of the fork lift truck.

2. The apparatus of claim 1, wherein said upper member, said lower member, and said spacers are constructed of steel plate.

3. The apparatus of claim 2, wherein said upper member, said lower member, and said spacers have a thickness ranging from 3/16" to ½".

4. The apparatus of claim 1, further comprising a safety chain for connecting said frame to a fork lift truck.

5. The apparatus of claim 4, further comprising said perpendicular member attached to the underside of said lower member, said perpendicular member having means for connection thereto of a safety chain.

6. The apparatus of claim 5, said means for connection further comprising an eye bolt for connection thereto of said safety chain.

7. The apparatus of claim 6, wherein welding is used as the means of construction of the apparatus.

8. The apparatus of claim 1, said first means for attaching said frame to the forks of the fork lift truck further comprising said upper generally horizontal member having a threaded aperture therein for receiving a threaded male member.

9. The apparatus of claim 8, further comprising an adjustment nut located on said threaded male member.

10. The apparatus of claim 9, further comprising a handle located on said threaded male member.

11. The apparatus of claim 1, further comprising a threaded male member passing through said aperture, said threaded male member having a nut thereon whereby said trailer hitch ball is attached to said frame.

* * * * *